US006551073B1

(12) United States Patent
O'Sullivan

(10) Patent No.: US 6,551,073 B1
(45) Date of Patent: Apr. 22, 2003

(54) MOBILE CONSTANT PRESSURE PUMPING ASSEMBLY

(75) Inventor: Kevin George O'Sullivan, Auckland (NZ)

(73) Assignee: W. S. Darley & Co., Melrose Park, IL (US)

( * ) Notice: Subject to any disclaimer, the term of this patent is extended or adjusted under 35 U.S.C. 154(b) by 0 days.

(21) Appl. No.: 10/054,326

(22) Filed: Oct. 26, 2001

(51) Int. Cl.[7] ..... F04B 53/00
(52) U.S. Cl. ..... 417/234; 417/15; 417/212
(58) Field of Search ..... 417/15, 212, 379, 417/390, 364, 234

(56) References Cited

U.S. PATENT DOCUMENTS

| | | | | | |
|---|---|---|---|---|---|
| 3,785,754 | A | | 1/1974 | Miller | |
| 3,864,914 | A | * | 2/1975 | Timmins | 417/15 |
| 4,065,228 | A | * | 12/1977 | McMillan | 417/212 |
| 4,343,060 | A | * | 8/1982 | Hildebrand et al. | 15/84 |
| 4,373,864 | A | | 2/1983 | Massey et al. | |
| 4,459,084 | A | * | 7/1984 | Clark | 417/11 |
| 4,518,053 | A | * | 5/1985 | Queveau | 180/14.2 |
| 4,526,516 | A | | 7/1985 | Swain et al. | |
| 4,541,243 | A | * | 9/1985 | Clark | 417/380 |
| 4,879,501 | A | * | 11/1989 | Haner | 290/40 R |
| 5,059,097 | A | | 10/1991 | Okazaki et al. | |
| 5,092,824 | A | * | 3/1992 | Connett | 417/212 |
| 5,197,860 | A | * | 3/1993 | Nishida et al. | 417/15 |
| 5,222,875 | A | * | 6/1993 | Clark | 417/370 |
| 5,876,184 | A | | 3/1999 | Marcott | |
| 5,947,695 | A | | 9/1999 | Nagaoka et al. | |
| 6,017,200 | A | * | 1/2000 | Childs et al. | 417/390 |
| 6,059,534 | A | * | 5/2000 | Kotake et al. | 180/307 |
| 6,095,760 | A | | 8/2000 | Houtman | |
| 6,149,401 | A | | 11/2000 | Iwanami et al. | |
| 6,216,456 | B1 | | 4/2001 | Mitchell | |

* cited by examiner

*Primary Examiner*—Charles G. Freay
*Assistant Examiner*—William H. Rodriguez
(74) *Attorney, Agent, or Firm*—Anthony J. Bourget

(57) ABSTRACT

The present invention is an assembly for pumping liquid at a constant, preselected outlet pressure, and includes an engine connected to a variable displacement hydraulic pump driven by the engine. A fixed displacement hydraulic motor driven by the variable displacement hydraulic pump includes a motor speed transducer. The fixed displacement hydraulic motor drives a liquid pump and contains a liquid outlet pressure transducer. A controller device modulates the output of the variable displacement hydraulic pump. The controller device is in communication with the liquid pump outlet pressure transducer, and with the fixed displacement hydraulic motor speed transducer. The controller thereby modulates the hydraulic output of the variable displacement hydraulic pump to maintain a constant, preselected liquid pump outlet pressure that is independent of engine speed and within the fixed displacement hydraulic motor speed maximum.

23 Claims, 3 Drawing Sheets

MOBILE CONSTANT PRESSURE PUMPING ASSEMBLY

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates generally to an assembly for pumping liquid at constant pressure, and more specifically, to a mobile assembly for pumping liquid at constant pressure that is independent of the assembly powering engine speed.

2. Background Information

The use of a pump mounted on a mobile platform, such as a vehicle, to deliver water to fight fires is well known. Modern pumper trucks are fitted with one or more pumps that transfer water from a reservoir or fire hydrant to the fire. The pressurized pump outlet water can be directed by the fire fighters with hoses or similar devices. The water pumps on a fire truck generally are powered by the truck engine. Frequently, a hydraulic pump and hydraulic motor system is used to transfer power from the truck engine to the water pump. Some of these pumper truck systems employ a pressure governor system that changes truck engine speed to control water pump outlet pressure. Other pumper truck systems include a manual control on the hydraulic system that is adjusted to control water pump outlet pressure. These systems have some inherent drawbacks that cause problems in both operation and maintenance of the pumper truck systems. Additionally, the operation and control of two pumping systems on a truck with both systems powered by that one truck engine is most difficult.

Some examples of inventions concerned with pumps or hydraulic systems for which patents have been granted are found in the following. Miller, U.S. Pat. No. 3,785,754; Massey et al., U.S. Pat. No. 4,373,864; Swain et al., U.S. Pat. No. 4,526,516; Okazaki et al., U.S. Pat. No. 5,059,097; Marcott, U.S. Pat. No. 5,876,184; Nogaoka et al., U.S. Pat. No. 5,947,695; Houtman, U.S. Pat. No. 6,095,760; Iwanami et al., U.S. Pat. No. 6,149,401; and Mitchell, U.S. Pat. No. 6,216,456.

None of these patents provide a system for controlling a water pump outlet pressure at a specified set point that is independent of powering engine speed. Consequently, applicants have invented a system for controlling a water pump outlet pressure at a specified set point that is independent of powering engine speed, while providing many additional features that are unique to the structure described herein.

SUMMARY OF THE INVENTION

The present invention is directed to an assembly for pumping liquid at a constant, preselected outlet pressure. The assembly includes an engine connected to a variable displacement hydraulic pump driven by the engine. A fixed displacement hydraulic motor in fluid communication with, and driven by the variable displacement hydraulic pump is present. The fixed displacement hydraulic motor includes a motor speed transducer. The fixed displacement hydraulic motor drives a liquid pump with intake and outlet for liquid, with the liquid pump including a liquid outlet pressure transducer. A controller device is operatively connected to the variable displacement hydraulic pump for modulating the hydraulic output thereof. The controller device is in communication with the liquid pump outlet pressure transducer, and is in communication with the fixed displacement hydraulic motor speed transducer. The controller thereby modulates the hydraulic output of the variable displacement hydraulic pump to maintain a constant, preselected liquid pump outlet pressure that is independent of engine speed, without exceeding a preselected fixed displacement hydraulic motor speed maximum.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which:.

Figure 1:
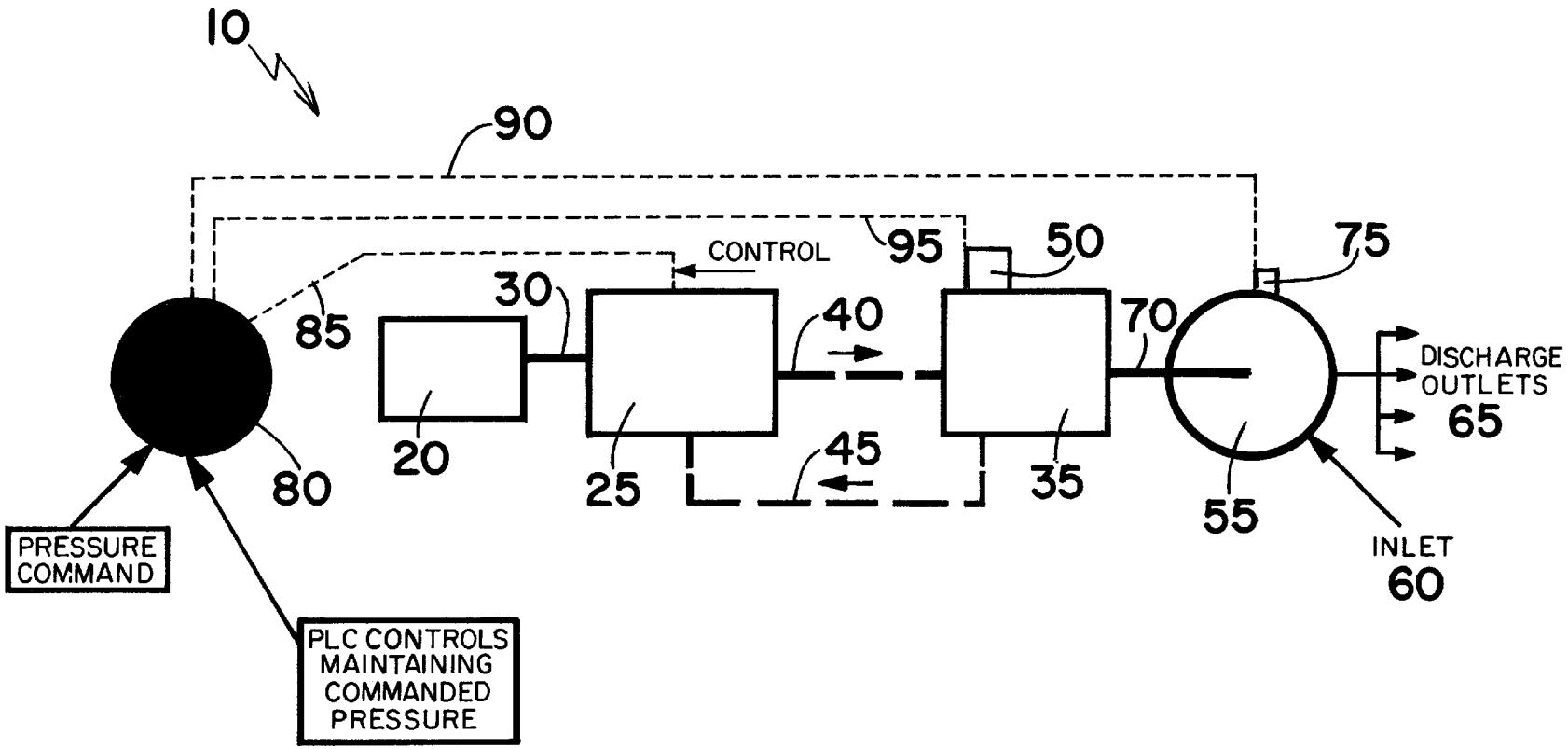
FIG. 1 shows a schematic representation of the components for one embodiment of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DESCRIPTION OF THE EMBODIMENTS

The present invention is directed to a pumping assembly that is mounted on a vehicle, such as a fire truck, for use in pumping liquid, such as water. The pumping assembly is powered by the truck engine, and includes a hydraulic pump and motor portion that transfers power from the truck engine to the water pump.

Referring to FIG. 1, one embodiment of the present invention is shown in schematic form. The pumping assembly 10 includes an engine 20, such as the engine of a fire truck, with the engine 20 connected to a variable displacement hydraulic pump 25 driven by a drive shaft 30 of the engine 20. A fixed displacement hydraulic motor 35 is in fluid communication with, and driven by the variable displacement hydraulic pump 25. The variable displacement hydraulic pump 25 provides power to the fixed displacement hydraulic motor 35 via a high pressure hydraulic line 40, with a low pressure hydraulic line 45 returning fluid from the hydraulic motor 35 to the hydraulic pump 25. The fixed displacement hydraulic motor 35 includes a motor speed transducer 50. A liquid pump 55 with an intake 60 and outlet 65 for liquid is driven by a drive shaft 70 from the fixed displacement hydraulic motor 35, with the liquid pump 55 including a liquid outlet pressure transducer 75.

An assembly controller device 80 is operatively connected to the variable displacement hydraulic pump 25 via a control line 85 for modulating the hydraulic output of the pump 25. The assembly controller device 80 is in communication with the liquid pump outlet pressure transducer 75 via a signal line 90. The assembly controller device 80 is also in communication with the fixed displacement hydraulic motor speed transducer 50 via another signal line 95. An operator selects the desired outlet pressure for the liquid pump 55 and enters the selected value as a pressure command at the controller device 80. The assembly controller device 80 then modulates the hydraulic output of the variable displacement hydraulic pump 25 to maintain a constant, preselected liquid pump outlet pressure, as measured by the liquid outlet pressure transducer 75. The controller device 80 also monitors the speed of the drive shaft 70 of the fixed displacement hydraulic motor 35 via the speed transducer 50. The controller device 80, typically an integrated circuit device or computer, contains data in memory on the revolutions per minute (RPM) vs. outlet pressure characteristics of the liquid pump 55. The operational parameters of the control device 80 prevent the fixed displacement hydraulic motor 35 from running faster than required for the selected outlet pressure of the liquid pump 55. This control feature prevents run-away or burn-out of the fixed displacement hydraulic motor 35 when the water supply to the liquid pump 55 is inadequate, restricted or interrupted, as well as preventing cavitation of the liquid pump 55. The selected outlet pressure of the liquid pump 55 is the primary control point for the controller device 80, however the controller device 80 also controls maximum limits for RPM values of the fixed displacement hydraulic motor 35 at each selected outlet pressure for the liquid pump 55.

The modulation of the hydraulic output of the variable displacement hydraulic pump 25 is typically achieved with the controller device 80 by adjusting the swash plate angle of the hydraulic pump 25. In this manner of control, the outlet pressure of the liquid pump 55 is maintained at a constant, preselected outlet pressure value that is independent of the operating speed of the truck engine 20.

Figure 3:
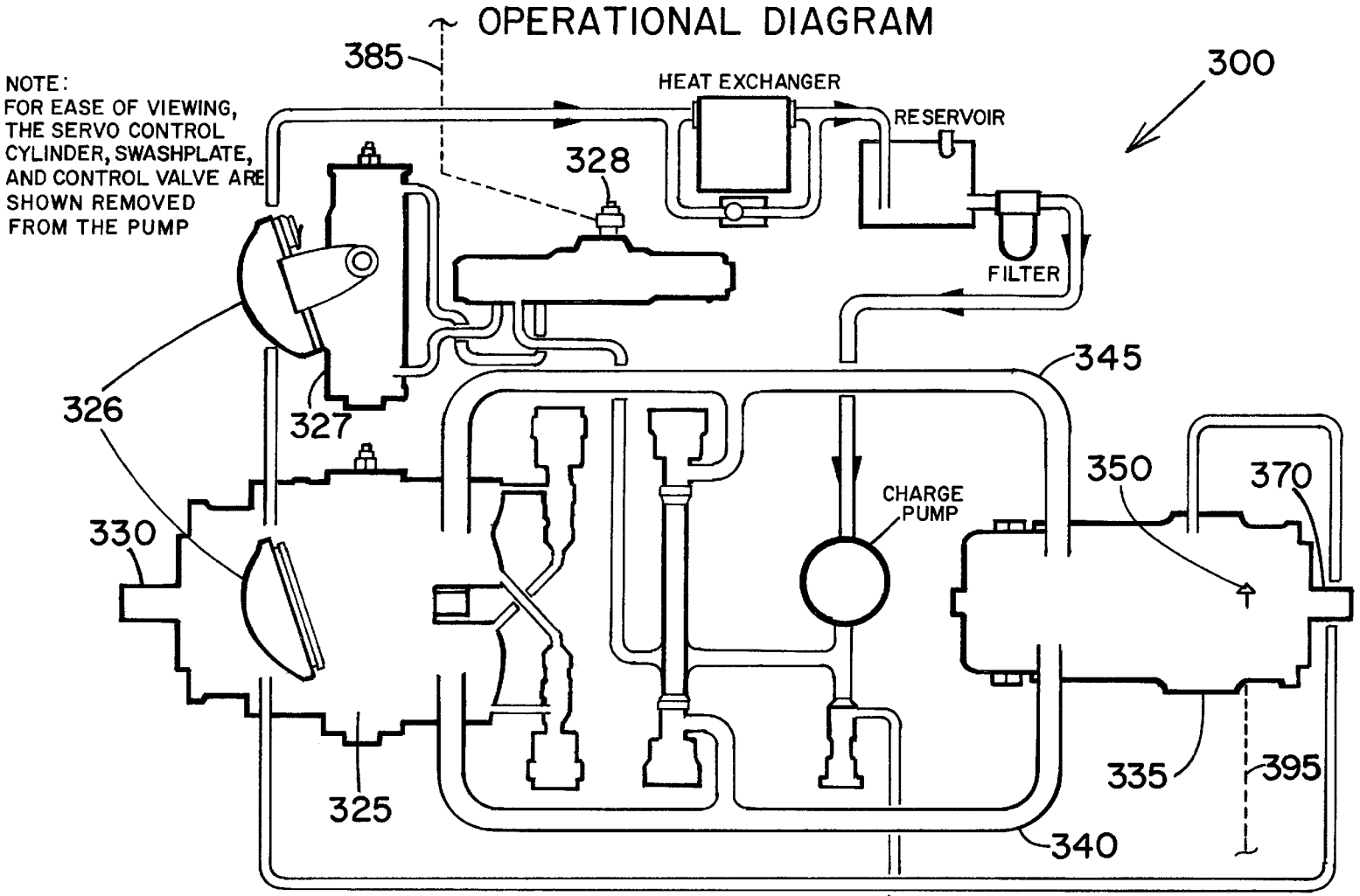
FIG. 3 shows a detailed operational diagram of the hydraulic pump and hydraulic motor combination for one embodiment of the present invention.

Referring to FIG. 3, an operational diagram of a typical hydraulic pump and motor system 300 employed in the present invention is shown. The variable displacement hydraulic pump 325 includes a swash plate 326 that is connected to a servo control cylinder 327 and an electronic displacement control valve 328 for varying the orientation of the swash plate 326. The fixed displacement hydraulic motor 335 is in fluid communication with, and driven by the variable displacement hydraulic pump 325 via the high pressure hydraulic line 340, with a low pressure hydraulic line 345 returning fluid from the hydraulic motor 335 to the hydraulic pump 325. The fixed displacement hydraulic motor 335 includes a motor speed transducer 350 and a drive shaft 370 connected to a liquid pump (not shown). A control line 385 allows the controller device 80 to modulate the hydraulic output of the variable displacement hydraulic pump 325, while a signal line 395 allows the control device 80 to monitor the drive shaft speed of the fixed displacement hydraulic motor 335. The controller device 80 sends a control signal to the electronic displacement control valve 328 which, via the servo control cylinder 327, varies the orientation of the swash plate 326 to modulate the hydraulic output of the variable displacement hydraulic pump 325, thereby maintaining a constant, preselected liquid pump outlet pressure value that is independent of the operating speed of the truck engine.

Figure 2:
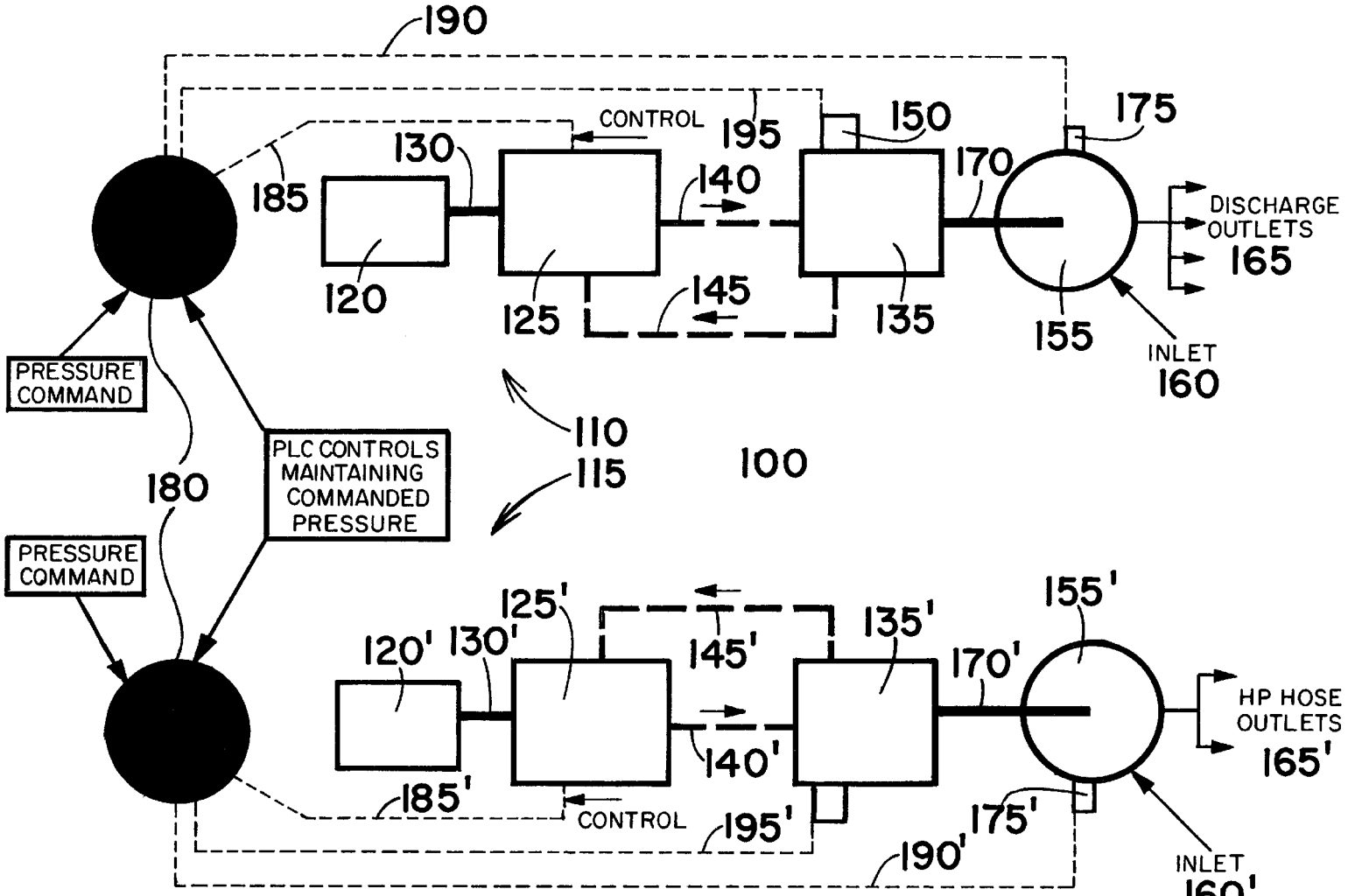
FIG. 2 shows a schematic representation of the components for another embodiment of the present invention.

In another embodiment of the invention, a system for independently pumping liquid at a plurality of constant preselected outlet pressures is shown schematically in FIG. 2. The pumping system 100 includes a first liquid pumping assembly 110 and a second liquid pumping assembly 115, each assembly powered by an engine 120, such as the engine of a fire truck. Each assembly 110, 115 includes a variable displacement hydraulic pump 125, 125' each driven by the drive shaft 130, of the engine 120. A fixed displacement hydraulic motor 135, 135' is in fluid communication with and driven by one of the variable displacement hydraulic pumps 125, 125'. The variable displacement hydraulic pumps 125, 125' each provides power to the fixed displacement hydraulic motor 135, 135', via a high pressure hydraulic line 140, 140', with a low pressure hydraulic line 145, 145' returning fluid from the hydraulic motor 135, 135' to the hydraulic pump 125, 125', respectively. Each fixed displacement hydraulic motor 135, 135' includes a motor speed transducer 150, 150'. Liquid pumps 155, 155', each with an intake 160, 160' and an outlet 165, 165' for liquid are driven by drive shafts 170, 170' from the fixed displacement hydraulic motors 135, 135', with each liquid pump 155, 155' including a liquid outlet pressure transducer 175, 175' respectively.

A system controller device 180 is operatively connected to the variable displacement hydraulic pump 125, 125' of each liquid pumping assembly 110, 115 via control lines 185, 185' for modulating the hydraulic outputs of the pumps 125, 125'. The system controller device 180 is in communication with the liquid pump outlet pressure transducers 175, 175' of each assembly 110, 115 via the signal lines 190, 190'. The system controller device 180 is also in communication with the fixed displacement hydraulic motor speed transducer 150, 150' of each assembly via another signal line 195, 195'. An operator selects the desired outlet pressure for the liquid pumps 155, 155' and enters the selected value as a pressure command at the controller device 180. The system controller device 180 then independently modulates the hydraulic outputs of the variable displacement hydraulic pump 125, 125' of each assembly 110, 115 to maintain independent, constant, preselected liquid pump outlet pressures for each assembly 110, 115, as measured by the liquid outlet pressure transducers 175, 175'. The controller device 180 also monitors the speeds of the drive shafts 170, 170' of the fixed displacement hydraulic motors 135, 135' via the speed transducers 150, 150'. The controller device 180, typically an integrated circuit device or computer, contains data in memory on the revolutions per minute (RPM) vs. outlet pressure characteristics of the liquid pumps 155, 155'. The operational parameters of the control device 180 prevent the fixed displacement hydraulic motors 135, 135' from running faster than required for the selected outlet pressure of the liquid pumps 155, 155'. This control feature prevents runaway or burn-out of the fixed displacement hydraulic motors 135, 135' when the water supply to the liquid pumps 155, 155' is inadequate, restricted or interrupted, as well as preventing cavitation of the liquid pumps 155, 155'. The selected outlet pressures of the liquid pumps 155, 155', are the primary control point for the controller device 180, however, the controller device 180 also controls maximum limits for RPM values of the fixed displacement hydraulic motors 135, 135' at each selected outlet pressure for the liquid pumps 155, 155'.

The modulation of the hydraulic output of the variable displacement hydraulic pumps 125, 125' is typically achieved with the controller device 180 by adjusting the swash plate of each of the hydraulic pumps 125, 125'. In this manor of control, the outlet pressure of the liquid pumps 155, 155' is maintained at a constant, preselected outlet pressure value that is independent of the operating speed of the truck engine 120.

The modulation of the hydraulic output of the variable displacement hydraulic pumps 125, 125' is as described for FIG. 3 as described above. The controller device 180 thereby maintains constant, preselected liquid pump outlet pressure values for each liquid pump 155, 155' that are independent of the operating speed of the truck engine 120.

The advantages and improvements of the constant pressure liquid pumping system of the present invention are numerous. These advantages and improvements are enumerated with reference to employing the invention on a fire truck for pumping water to fight fires.

The system of the present invention maintains a required water pump pressure over a wide range of engine speeds, thus permitting the vehicle engine to operate to achieve other functions. The vehicle engine can be used for vehicle mobility or other auxiliary drive needs while retaining the water pump pressure setting. The system of the present invention permits two pump installations to be mounted on one vehicle. Each pump is operated at a required pressure which is separately maintained and is independent of the other pump pressure, as well as being independent of incoming water pressure.

The system of the present invention permits installation of a high-pressure pump and a low-pressure pump on one vehicle. High-pressure water for hose-reel service is achieved solely by operation of a (smaller) high-pressure pump, at low engine speed, without operating a (larger) low-pressure pump at all. This feature results in reduced wear on the larger, low-pressure pump. Reduced noise levels from the engine and pumping machinery occur when operating the more frequently used high-pressure pump.

The system of the present invention permits the low pressure pump to be brought into simultaneous use without disengaging the high pressure pump, and with both pumps operating simultaneously with operator selected pressures on each pump. The system permits tot al stop of the moving water pump components when the truck engine or the individual water pump is at idle, thereby reducing noise and low speed gear backlash. Also, pressure reduction to control "spikes" is achieved far more quickly than by an engine governing system because of the greater speed at which the controlling hydraulic pump swash plate can be "destroked".

Additionally, a range of control speed "ramps" is built into the controller device 80, 180 for selecting the rate of pressure increase for the water pump outlets. Pump priming is also improved because the water pump impellers are stationery during priming.

A further embodiment of the invention includes an assembly for pumping liquid at a constant, preselected outlet pressure comprising an engine, a motor means driven by the engine, a liquid pump means for pumping liquid, the liquid pump means driven by the motor means, and controlling means for control ling the output of the motor means to maintain a constant, preselected liquid pump outlet pressure that is independent of engine speed. Such assembly and features are further shown in the above description and drawings. A system of such assemblies can be assembled in order to independently pump liquid at a plurality of constant preselected outlet pressures. Multiple pumping assemblies can be combined for desired operations.

While the present invention has been described with reference to several particular example embodiments, those skilled in the art will recognize that many changes may be made thereto without departing from the spirit and scope of the present invention, which is set forth in the following claims.

I claim:

1. An assembly for pumping liquid at a constant, preselected outlet pressure comprising;

(a) an engine;

(b) a variable displacement hydraulic pump driven by said engine;

(c) a fixed displacement hydraulic motor in fluid communication with and driven by said variable displacement hydraulic pump, said fixed displacement hydraulic motor including a motor speed transducer;

(d) a liquid pump with intake and outlet for liquid, said liquid pump driven by said fixed displacement hydraulic motor, said liquid pump including a liquid outlet pressure transducer; and (e) a controller device operatively connected to said variable displacement hydraulic pump for modulating the hydraulic output thereof, the controller in communication with said liquid pump outlet pressure transducer, and in communication with said fixed displacement hydraulic motor speed transducer, said controller thereby modulating the hydraulic output of the variable displacement hydraulic pump to maintain a constant, preselected liquid pump outlet pressure that is independent of engine speed.

2. The assembly for pumping liquid at a constant, preselected outlet pressure according to claim 1 wherein the variable displacement hydraulic pump includes a swash plate for modulating the hydraulic output thereof.

3. The assembly for pumping liquid at a constant, preselected outlet pressure according to claim 2 wherein said variable displacement hydraulic pump includes a servo control cylinder and control valve assembly for controlling a swash plate angle therein.

4. The assembly for pumping liquid at a constant, preselected outlet pressure according to claim 1 wherein said engine is an engine of a fire truck vehicle.

5. The assembly for pumping liquid at a constant, preselected outlet pressure according to claim 1 wherein said liquid pump is a water pump.

6. The assembly for pumping liquid at a constant, preselected outlet pressure according to claim 1 wherein said hydraulic pump, said hydraulic motor, said liquid pump and said controller device are positioned on a fire truck vehicle.

7. The assembly for pumping liquid at a constant, preselected outlet pressure according to claim 1 wherein said controller device includes an integrated circuit and a readable memory.

8. The assembly for pumping liquid at a constant, preselected outlet pressure according to claim 1 wherein said controller device modulates the hydrolic output of the variable displacement hydraulic pump to maintain a constant, preselected liquid pump outlet pressure that is independent of engine speed, without exceeding a preselected fixed displacement hydraulic motor speed maximum.

9. An assembly for pumping liquid at a constant, preselected outlet pressure comprising;

(a) an engine;

(b) a variable displacement hydraulic pump having a swash plate, said pump driven by said engine;

(c) a servo control cylinder and control valve assembly for controlling a swash plate angle of said variable displacement hydraulic pump;

(d) a fixed displacement hydraulic motor in fluid communication with and driven by said variable displacement hydraulic pump, said fixed displacement hydraulic motor including a motor speed transducer;

(e) a liquid pump with intake and outlet for liquid, said liquid pump driven by said fixed displacement hydraulic motor, said liquid pump including a liquid outlet pressure transducer; and (f) a controller device operatively connected to said servo control cylinder and control valve assembly for modulating the swash plate angle of said variable displacement hydraulic pump and hydraulic output thereof, said controller in communication with said liquid pump outlet pressure transducer, and in communication with said fixed displacement hydraulic motor speed transducer, said controller thereby modulating the hydraulic output of said variable displacement hydraulic pump to maintain a constant, preselected liquid pump outlet pressure that is independent of engine speed.

10. The assembly for pumping liquid at a constant, preselected outlet pressure according to claim 9 wherein said engine is an engine of a fire truck vehicle.

11. The assembly for pumping liquid at a constant, preselected outlet pressure according to claim 9 wherein said liquid pump is a water pump.

12. The assembly for pumping liquid at a constant, preselected outlet pressure according to claim 9 wherein said hydraulic pump, said hydraulic motor, said liquid pump and said controller device are positioned on a fire truck vehicle.

13. The assembly for pumping liquid at a constant, preselected outlet pressure according to claim 9 wherein said controller device includes an integrated circuit and a readable memory.

14. The assembly for pumping liquid at a constant, preselected outlet pressure according to claim 9 wherein said controller device modulates the hydraulic output of the variable displacement hydraulic pump to maintain a constant, preselected liquid pump outlet pressure that is independent of engine speed, without exceeding a preselected fixed displacement hydrolic motor speed maximum.

15. A system for independently pumping liquid at a plurality of constant preselected outlet pressures comprising;

(a) an engine;

(b) first and second liquid pumping assemblies, each assembly including (i) a variable displacement hydraulic pump driven by said engine;

(ii) a fixed displacement hydraulic motor in fluid communication with and driven by said variable displacement hydraulic pump, said fixed displacement hydraulic motor including a motor speed transducer;

(iii) a liquid pump with intake and outlet for liquid, said liquid pump driven by said fixed displacement hydraulic motor, said liquid pump including a liquid outlet pressure transducer; and (c) a controller device operatively connected to said variable displacement hydraulic pump of each assembly for modulating the hydraulic outputs thereof, said controller in communication with said liquid pump outlet pressure transducer of each assembly, and in communication with said fixed displacement hydraulic motor speed transducer of each assembly, said controller thereby independently modulating the hydraulic output of said variable displacement hydraulic pump of each assembly to maintain an independent, constant, preselected liquid pump outlet pressure that is independent of engine speed for each assembly.

16. The system for pumping liquid at a constant, preselected outlet pressure according to claim 15 wherein said variable displacement hydraulic pump of each assembly includes a swash plate for modulating the hydraulic output thereof.

17. The system for pumping liquid at a constant, preselected outlet pressure according to claim 16 wherein said variable displacement hydraulic pump of each assembly includes a servo control cylinder and control valve assembly for controlling a swash plate angle therein.

18. The system for pumping liquid at a constant, preselected outlet pressure according to claim 15 wherein said engine is an engine of a fire truck vehicle.

19. The system for pumping liquid at a constant, preselected outlet pressure according to claim 15 wherein said liquid pump of each assembly is a water pump.

20. The system for pumping liquid at a constant, preselected outlet pressure according to claim 15 wherein said hydraulic pump, said hydraulic motor, and said liquid pump of each assembly and said controller device of said system are positioned on a fire truck vehicle.

21. The system for pumping liquid at a constant, preselected outlet pressure according to claim 15 wherein said controller device includes an integrated circuit and a readable memory.

22. The system for pumping liquid at a constant, preselected outlet pressure according to claim 15 wherein said controller device modulates the hydraulic output of the variable displacement hydraulic pump to maintain a constant, preselected liquid pump outlet pressure that is independent of engine speed, without exceeding a preselected fixed displacement hydraulic motor speed maximum.

23. A mobile assembly for pumping liquid at a constant preselected outlet pressure comprising:

(a) a fire truck vehicle having an engine.

(b) a variable displacement hydraulic pump driven by said engine (c) a fixed displacement hydraulic motor in fluid communication with and driven by said variable displacement hydraulic pump, said fixed displacement hydraulic motor including a motor speed transducer;

(d) a liquid pump with intake and outlet for liquid, said liquid pump driven by said fixed displacement hydraulic motor, said liquid pump including a liquid outlet pressure transducer; and (e) a controller device operatively connected to said variable displacement hydraulic pump for modulating the hydraulic output thereof, the controller in communication with said liquid pump outlet pressure transducer, and in communication with said fixed displacement hydraulic motor speed transducer, said controller thereby modulating the hydraulic output of the variable displacement hydraulic pump to maintain a constant, preselected liquid pump outlet pressure that is independent of engine speed.

* * * * *